US005662086A

United States Patent [19]

Piccinini

[11] Patent Number: 5,662,086

[45] Date of Patent: Sep. 2, 1997

[54] CARBURATION DEVICE IN PARTICULAR FOR INTERNAL COMBUSTION ENGINES

[76] Inventor: Giuseppe Raoul Piccinini, Via Strada Nuova per Isorella, Gottolengo (Brescia), Italy

[21] Appl. No.: 547,936

[22] Filed: Oct. 25, 1995

[30] Foreign Application Priority Data

Oct. 25, 1994 [IT] Italy ..... CR94A0004

[51] Int. Cl.[6] ..... F02M 35/10; F02D 9/18

[52] U.S. Cl. ..... 123/403; 123/184.56

[58] Field of Search ..... 123/391, 401, 123/403, 184.56, 439

[56] References Cited

U.S. PATENT DOCUMENTS

| | | | |
|---|---|---|---|
| 2,066,544 | 1/1937 | Shaw | 261/62 |
| 2,569,024 | 9/1951 | Schnaible et al. | 123/439 |
| 3,875,918 | 4/1975 | Loynd | 123/184.56 |
| 3,937,186 | 2/1976 | Stock et al. | 123/403 |
| 4,054,621 | 10/1977 | Bubniak et al. | 261/46 |
| 4,411,233 | 10/1983 | Chenet et al. | 123/439 |
| 4,858,567 | 8/1989 | Knapp | 123/184.56 |
| 4,928,638 | 5/1990 | Overbeck | 123/184.56 |
| 5,216,985 | 6/1993 | Brummer et al. | 123/184.56 |

FOREIGN PATENT DOCUMENTS

| | | | |
|---|---|---|---|
| 1.596.218 | 6/1970 | France . | |
| 2 239 599 | 2/1975 | France . | |
| 493 148 | 2/1930 | Germany . | |
| 917 154 | 7/1954 | Germany . | |
| 32 00 744 | 7/1983 | Germany . | |
| 62-13768 | 1/1987 | Japan | 123/184.56 |
| 251 218 | 7/1948 | Switzerland . | |
| 1098596 | 1/1968 | United Kingdom . | |

*Primary Examiner*—Willis R. Wolfe

*Attorney, Agent, or Firm*—Cushman Darby & Cushman Intellectual Property Group of Pillsbury Madison & Sutro LLP

[57] ABSTRACT

In order to obviate the drawbacks of fluid-dynamic character which affect the traditional carburators equipped with control valves of throttle or of guillotine type, the carburation device provides for the feed duct to be a tubular portion made of an elastic material constrained at its ends and that at least one pair of relatively movable blades act on the elastic feed duct on its outer surface, squeezing it in a perpendicular direction relatively to its axis. The surface area of the cross-section of the inner bore of the duct varies taking (relatively to the fuel stream flowing through it) a gradually convergent-divergent shape, i.e., without sharp changes in the inner bore cross-section surface area, and the fuel stream therefore has a fluid-dynamically optimal motion which is independent from the actual revolution speed of the engine.

6 Claims, 6 Drawing Sheets

CARBURATION DEVICE IN PARTICULAR FOR INTERNAL COMBUSTION ENGINES

BACKGROUND OF THE INVENTION

The present invention relates to a carburation device in particular for internal combustion engines.

At present, such a kind of device substantially comprise the following elements: means for delivering the fuel at a metered rate relatively to combustion-supporting air according to the desired stoichiometric ratio; a supply duct for at least one from the following fluids: combustion-supporting air and combustible mixture obtained by mixing combustion-supporting air with fuel; and suitable means for varying the surface area of the internal bore of the feed duct in order to change the revolution speed of the engine with which the carburation device can be associated.

The feed duct can be co-axially constrained to the intake duct of the engine it is destined for. The suitable means for varying the surface area of the inner bore of the feed duct are presently constituted by throttle valves or guillotine valves which, by acting inside the feed duct, choke it as a function of the instantaneous performance required from the engine.

Unfortunately, some time ago it was discovered that such throttle or guillotine valves considerably disturb the fuel stream which consequently, by displaying irregularities from a fluid-dynamic point of view, generate drawbacks.

These drawbacks are well-known for those skilled in the art and therefore only the main ones of them are generally mentioned: lower torque at low revolution speed values, smaller power at high values of revolution speed values, and higher actual specific consumption than theoreticallly required.

At present, in order to at least partially obviate the above-mentioned drawbacks, the valve manufacturers give such throttle or guillotine valves such shapes as to limit as far as possible the fluid-dynamic disturbance caused by these valves, and design such valves for use in several engines based on target engine characteristics and envisaged usage.

SUMMARY OF THE INVENTION

The purpose of the present invention is of obviating the above-mentioned drawbacks, i.e., providing a carburation device which is capable of choking the stream of combustible mixture supplied without substantially altering the fluid-dynamic character of its flow, i.e., always keeping the fluid-dynamic flow under best conditions in order that the subsequent combustion inside the engine may take place with the maximal conversion of heat energy liberated by the combustion of the fuel mix, into mechanical energy, independently of the instantaneous engine revolution speed.

By positioning the suitable means for varying the surface area of the cross-section of the internal bore of the feed duct outside of that duct, such means no longer have any effects on the flow of combustion-supporting air or combustible streams, which therefore flow according to the best fluid-dynamic conditions. The absence of valves inside the interior of the feed duct makes it furthermore possible any hindrances to be removed from the interior of the feed duct, which might be generated by the necessary devices for constraining and actuating the valves, with further advantages being gained as regards the regularity of flow of combustion-supporting air or combustible streams.

Choking the feed duct by transversely squeezing it relative to its longitudinal axis (preferably by perpendicular squeezing) always causes, independently of the size of the transverse cross-section, a convergent-divergent portion to be formed which, from the fluid-dynamic viewpoint, is an optimal structure for stream flow through it.

The feed duct is preferably made from an elastic material. The elasticity of the material can be therefore used in order to cause the feed duct to automatically return back to its original conditions after being deformed. In such a case, the suitable means for varying the surface area of the cross-section of the internal bore can be simplified in their structure, because it is not necessary that they be capable of acting on the duct also when the duct must be returned back to its original conditions of maximal inner bore cross-sectional surface area.

Preferably, the suitable means for varying the surface area of the cross-section of the internal bore comprise at least one pair of mutually movable blades.

This means that: in a first case, a first blade is movable relative to the second blade, which is stationary and therefore acts as a fixed shoulder for the first one. In the second case, both blades are movable in synchronism until they completely shut the feed duct; this shutting preferably taking place at the middle of the internal bore. In all above-mentioned cases, the feed duct gets deformed, with its interior bore taking a convergent-divergent shape. The experience will allow those skilled in the art to understand when a device according to the invention should be used with either one, or both blades being movable.

According to the available room and the structure of the actuator means used to drive the blades, the actuator means can be electrical, hydraulic, pneumatic or even of manual type, by means of a Bowden cable.

According to a possible embodiment, at least one of the blades is hinged at one of its ends, so as to act as if it was a pressing cam urging on the feed duct, while the other blade, which is stationary, simply acts as a shoulder. According to further possible embodiments, at least one of the blades slides along guides, so as to act as a guillotine blade pressing on the feed duct, whereas the other blade acts as a stationary or movable shoulder. The selection of the movement type and of the type of actuation device for the blades is usually carried out as a function of the structure and of the usage the engine is designed for. The possibility of individually actuating the blades enables the operator to act on combustible mixture feed in the best way relative to the usage conditions. The blades are actuated by the operator by means of the gas pedal, together with the means for delivering metered amounts of fuel, relative to the combustion-supporting air according to the desired stoichiometric ratio; however, the selection of the modality of actuation of the blades can be committed to a central electronic control unit.

In order to increase the fluid-dynamic effects, the feed duct is, under its fully opened condition, preferably of the convergent type, and is provided with end flanges in order to allow it to be fastened.

BRIEF DESCRIPTION OF THE DRAWINGS

The invention is illustrated for merely exemplifying, non-limitative purposes in the accompanying drawings which display some possible embodiments.

In the drawings.

DETAILED DESCRIPTION

Figure 1:
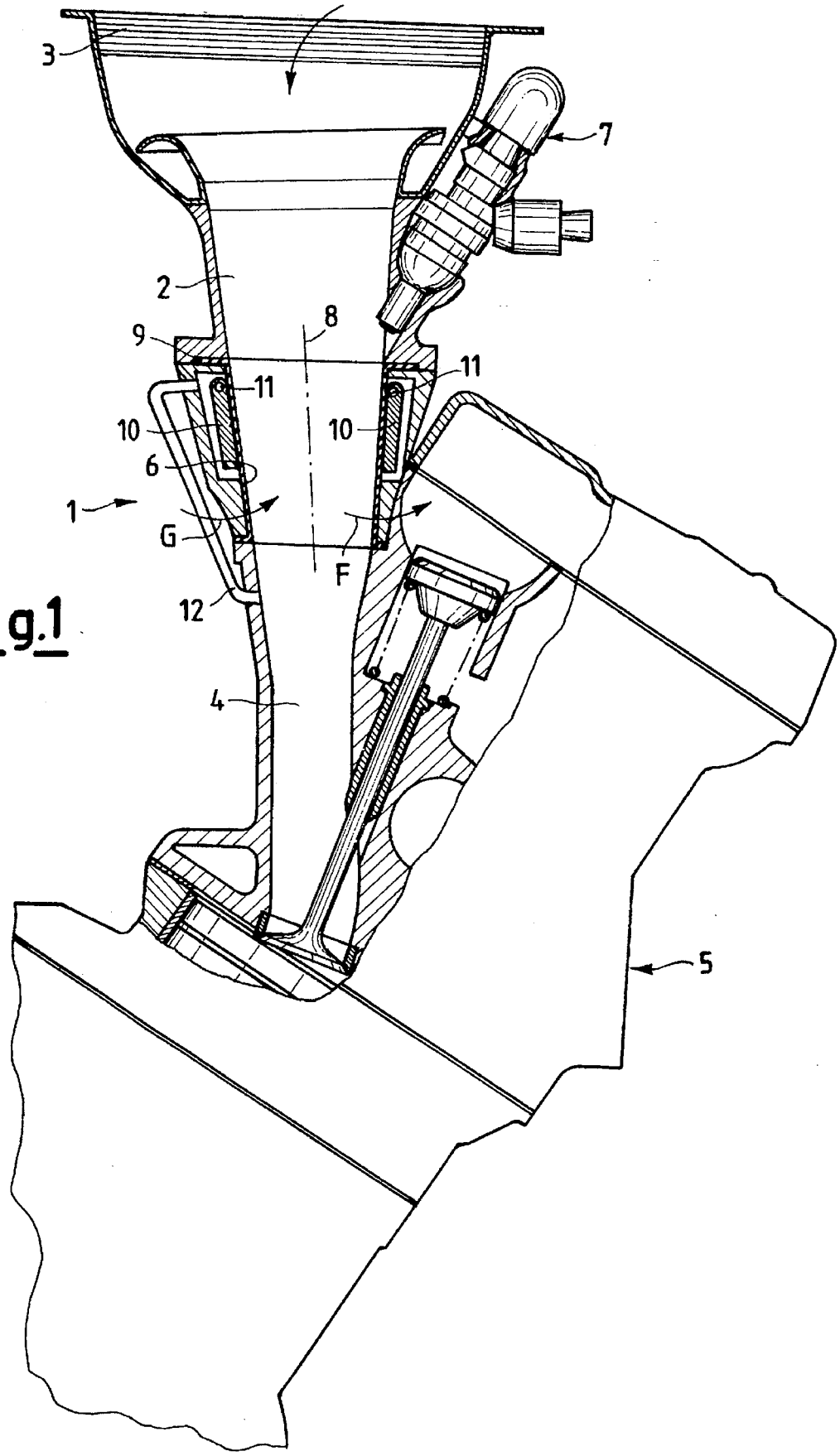
FIG. 1 is a sectional view of a device according to the present invention as applied to an internal combustion engine. In the illustrated device, the means for metered delivery of fuel comprises an injector means.

Referring in particular to FIG. 1, the device according to the invention, generally indicated by the numeral (1), is installed between an intake fitting (2) and the relevant filter (3) and an intake duct (4) of an internal combustion engine (5). The device (1) comprises a body (9), a feed duct (6) the longitudinal axis of which is indicated by the numeral (8), one pair of mutually opposite blades (10), and an injection unit (7). The body (9) is a rigid support structure which houses and constrains the feed duct (6) at its ends, and internally supports the pair of blades (10).

The feed duct (6) has a convergent shape and is made from an elastic material which is capable of withstanding heat while keeping practically unchanged its elasticity characteristics. The preferably used materials for producting the feed duct (6) are fluoro-silicone rubbers, or a material marketed under the trade name "Viton".

The blades (10) are keyed on the pivots (11), which are driven to revolve by actuator means, not illustrated in the figure, which can be of mechanical, electrical or pneumatic type. The actuator means are controlled by the gas pedal in synchronism with the injection unit (7). The device (1) furthermore comprises a compensation duct (12) which connects the internal chamber of the body (9) with the intake duct (4). In such a way, the pressure existing inside the interior of body (9), or, better, between the inner surface of the body (9) and the external surface of the feed duct (6), and the internal pressure inside the intake duct are always the same. In such a way, phenomena of prolonged squeezing of feed duct (6) are avoided, which may follow sudden actuations of blades (10) (duct opening and shutting, arrows "F" and "G", respectively), above all when the engine operates under release conditions, at a high revolution speed.

Figure 2:
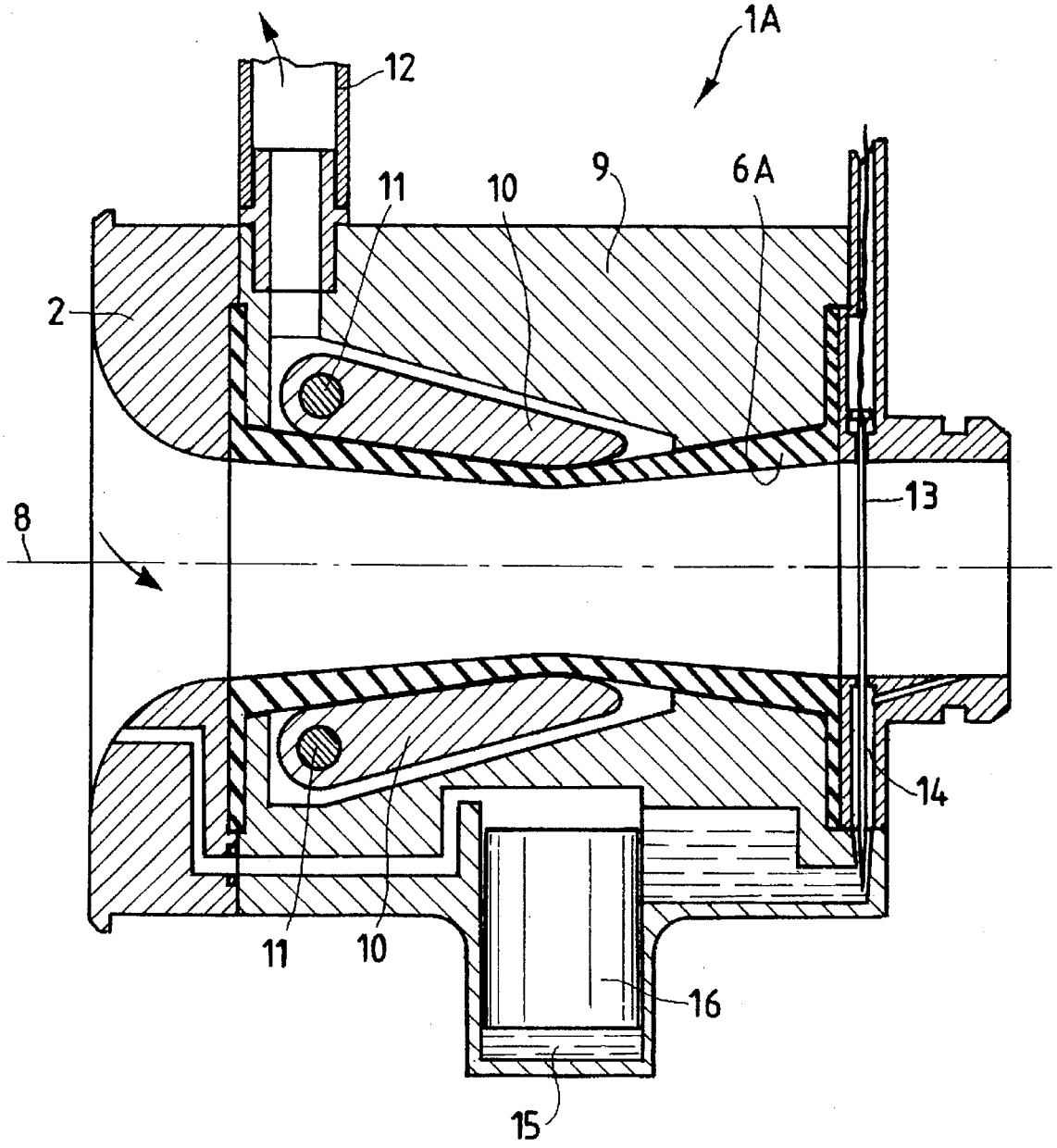
FIG. 2 is a sectional view of a device according to the invention, which can be applied to internal combustion engines. In the illustrated device, the means for metered fuel delivery are those which are usually present in a traditional carburator.

Referring in particular to FIG. 2, the device (1A) illustrated in this figure is different from the preceding one mainly owing to the structure of the feed duct (6A) and the structure of the means for metered fuel supply relative to combustion-supporting air. The feed duct (6A) is of convergent-divergent type. Instead of being constituted by the injection unit (7), the means for metered fuel supply relative to combustion-supporting air are those of a traditional carburator. Therefore, they essentially comprise a slow-running (idling) mixture delivery nozzle (not visible in figure) and a maximal-speed running mixture-delivery nozzle (14), operatively associated with a cup (15)-float (16) assembly. The surface area of the cross-section of the calibrated bore of the maximal speed running mixture-delivery nozzle (14) is determined by the vertical position inside the bore of a calibrated pin (13), the sliding of which is synchronized with the motion of the blades (10), which are the suitable means for varying the surface area of the cross-section of the internal bore of the feed duct (6A). The residual elements of the device (1A) of FIG. 2 have been identified with the same reference numerals as have been used for the device (1) of FIG. 1.

Figure 4:
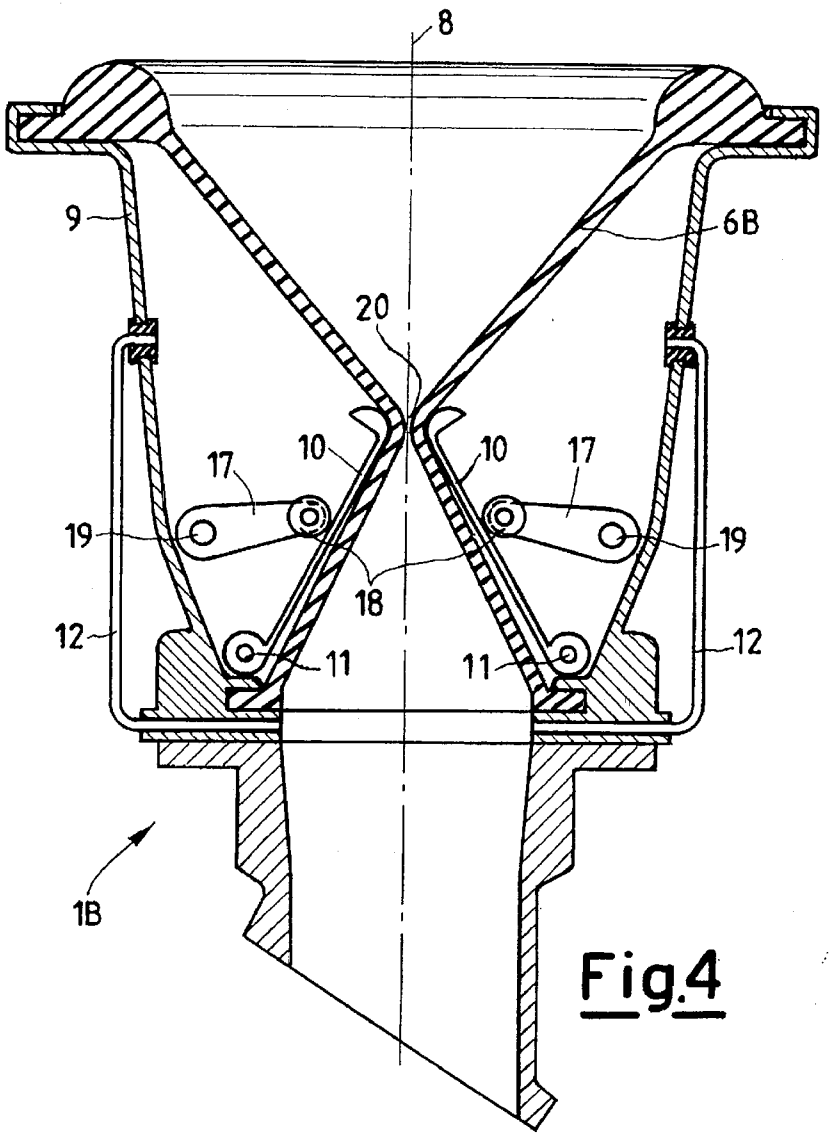
FIGS. 3 and 4 show sectional views of a device according to the present invention in its maximal delivery rate and minimal delivery rate positions, respectively, as applied in lieu of the intake fitting on a racing engine. The means for metered fuel delivery are not illustrated for the sake of simplicity; however, they preferably comprise an injection device provided with at least one injector means.
Figure 3:
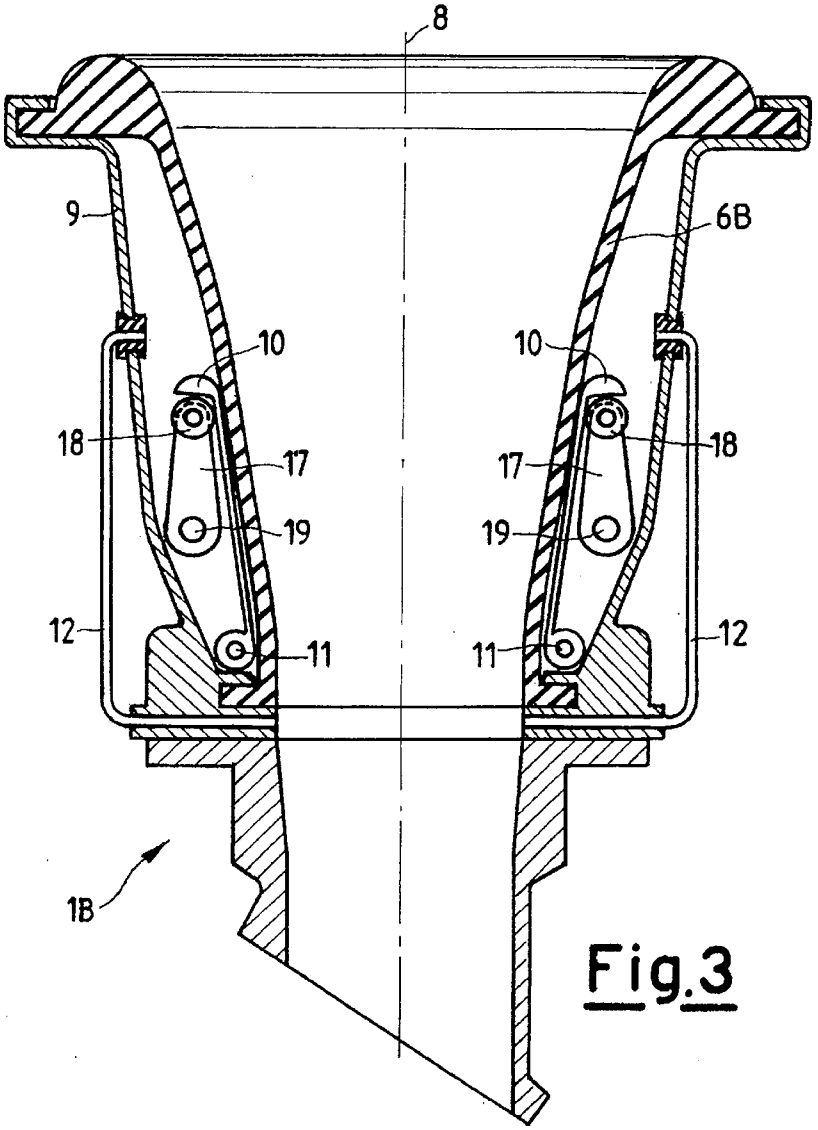

Referring in particular to FIGS. 3 and 4, the device (1B) illustrated in these figures mainly differs from the preceding devices because the blades (10) are actuated in this case by respective cams (17) hinged at (19) and equipped with an end bearing (18) which allows them to be actuated more smoothly and reduces the wear of the implied parts.

It should be observed that in the illustrated case, the feed duct (6B) also acts as the intake fitting. The residual elements have been indicated with the same reference numerals.

For the sake of simplicity, the means for metered fuel delivery relative to combustion-supporting air according to the desired stoichiometric ratio are not illustrated; however, they are constituted by an injection unit comprising at least one nozzle which can be indifferently installed upstream or downstream from the line (20) along which the feed duct (6B) gets choked/shut. In the case, when the nozzle is installed upstream, through the feed duct (6B) the combustion-supporting air and the fuel mixture obtained from combustion-supporting air mixing with fuel (i.e., the "combustible mixture") will flow. In the case when the nozzle is installed downstream, through the feed duct (6B) only combustion-supporting air will flow.

Figure 5:
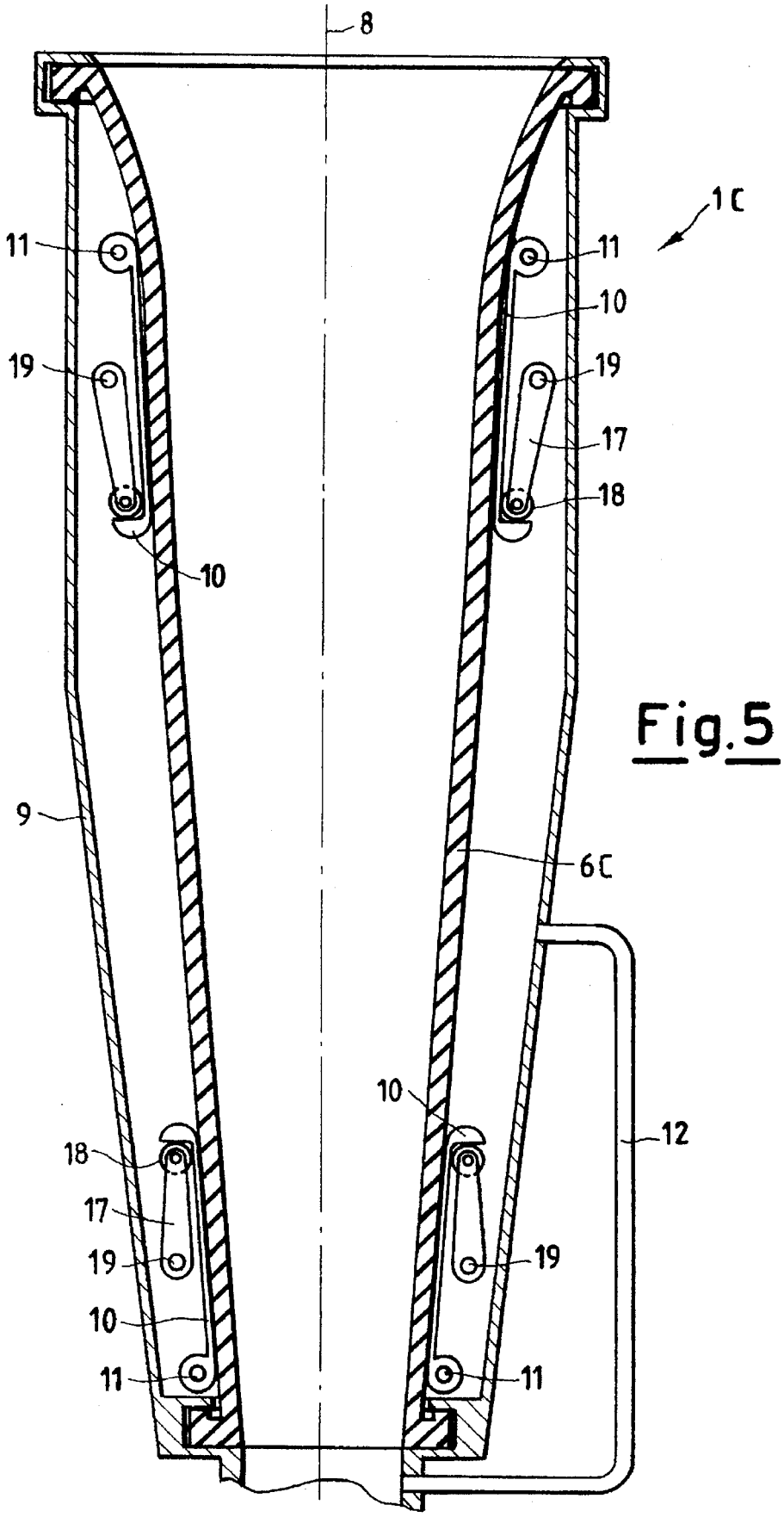
FIG. 5 schematically illustrates, in sectional view, a device according to the present invention in which there are two sets of suitable means for varying the surface area of the cross-section of the internal bore of the feed duct. For the sake of simplicity, the means for metered fuel delivery are not illustrated, however they preferably comprise an injection device provided with at least one injector means.

Referring now in particular to FIG. 5, the carburation device (1C) illustrated in this figure mainly differs from the preceding one in that two sets of the suitable means for varying the surface area of the cross-section of the inner bore of the feed duct are present.

In order to fully understand the considerable advantages offered by such an embodiment, it should be borne in mind that the characteristic of an internal combustion engine is strongly conditioned by the size of its intake duct. Summarizing, an engine provided with a slim (i.e., narrow and long) intake duct displays tendentially flat power and torque curves, i.e.: power and torque change only slightly as the revolution speed (revolutions per minute) of engine changes.

An engine equipped with a squat intake duct shows high-slope power and torque curves, i.e.: power and torque vary considerably with varying revolution speed (revolutions per minute).

Figure 6:
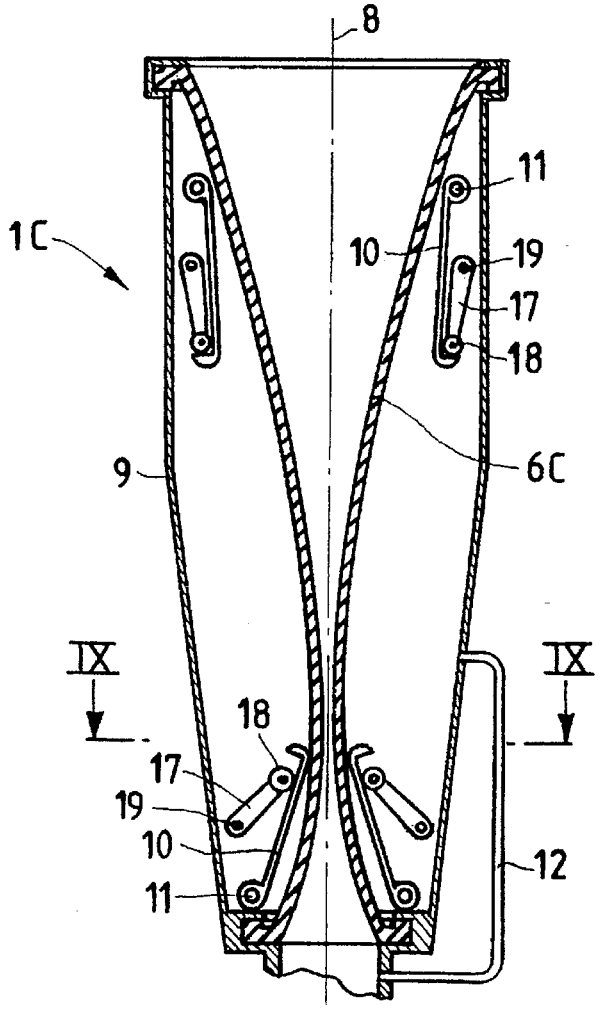
FIGS. 6–8 schematically illustrate the device shown in FIG. 5, in those configurations it takes when the suitable means for varying the surface area of the cross-section of the internal bore of the feed duct are variously actuated.
Figure 9:
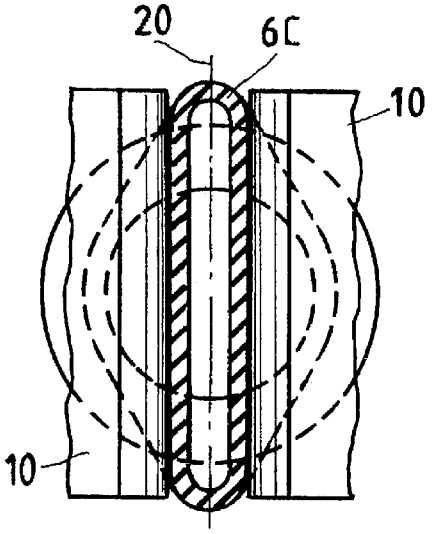
FIG. 9 shows a sectional view along the section line IX—IX of FIG. 6.
Figure 8:
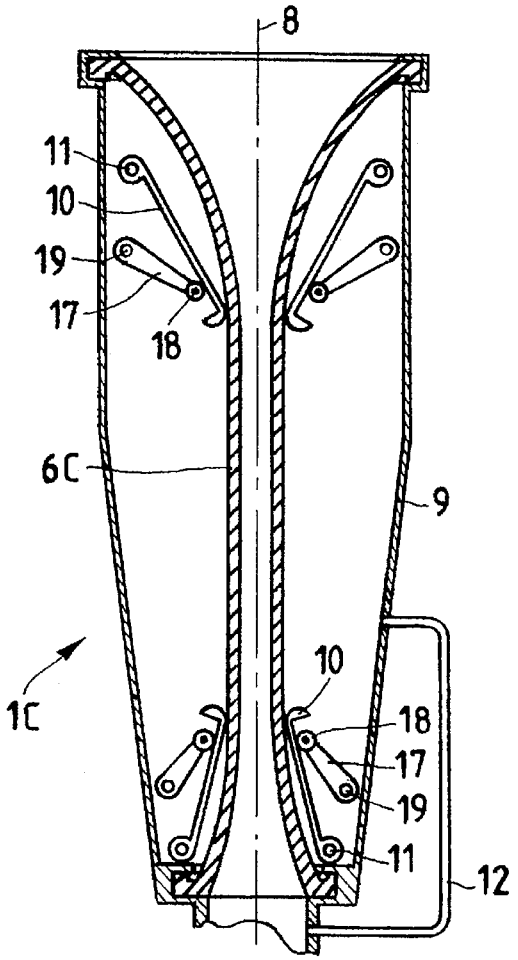
Figure 7:
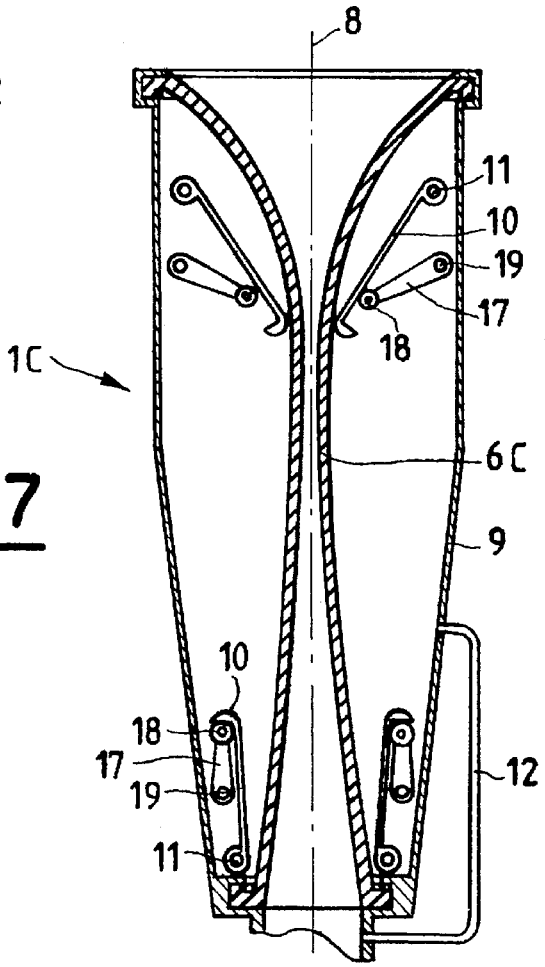

By doubling the suitable means for varying the surface area of the cross-section of the internal bore of the feed duct, i.e., by providing two pairs of blades (10) respectively arranged at both ends of feed duct (6C), also the shape of the feed duct (6C) can be changed, which can take a slimmer or less slim shape (FIG. 8) and therefore a squatter or less squat shape (FIG. 5), thus influencing the characteristic of the engine. Furthermore, by actuating only one of both blade (10) pairs, the feed duct (6C) can be given a convergent shape (FIG. 6) or a divergent shape (FIG. 7). It is important to observe that in an internal combustion engine provided with the device (1C), the feed duct (6C), or the intake duct of the engine it is associated with, can be given an as large as possible size, then leaving to the device (1C) the task of shaping, and/or decreasing the cross-section of the feed duct as a function of engine running requirements, with the engine resulting capable of both supplying a high specific power and a high specific torque also at those values of revolution speed which are commonly regarded as being slow.

In other terms, it is possible to obtain that, according to the requirements, an engine of the same type can have the same performances of a high-specific-power-engine or of a high-specific torque-engine. This performance was unknown until the advent of the present invention, because the values of the geometric parameters of the intake (4)-feed (6) ducts have always been selected based on the best balance between power and torque requirements.

I claim:

1. A carburation device for an internal combustion engine, comprising:

means for delivering metered amounts of fuel relative to combustion-supporting air according to a desired stoichiometric ratio;

a feed duct for at least one fluid selected from the group consisting of combustion-supporting air, and a mixture of combustion-supporting air and fuel, said feed duct having a longitudinal bore having an inlet end and an outlet end;

means for co-axially constraining the outlet end of said feed duct to an intake duct of an internal combustion engine, for supplying a mixture of fuel and combustion-supporting air to the engine;

means for varying the transverse cross-sectional area of said longitudinal bore of said feed duct for varying the supply of fuel-air mixture through the outlet end, and thereby varying the revolution speed of the engine;

said feed duct being tubular and made of an elastic, flexible material;

said means for varying including means for squeezing said feed duct transversally of the longitudinal axis thereof, from externally of said feed duct so as to cause said feed duct, when squeezed, to have a longitudinal profile, as viewed transversally of said longitudinal axis and transversely of squeezing provided by said means for varying, which includes flattened, maximally to complete closure, axially central segment, preceded by an upstream segment of smoothly converging transverse cross-sectional shape, without any sharp changes in transverse cross-sectional shape, and succeeded by a downstream segment of smoothly diverging transverse cross-sectional shape, without any sharp changes in transverse cross-sectional shape.

2. The carburation device of claim 1, wherein:

said varying means comprises at least two blades, and means for moving at least one of said blades towards and away from another of said blades.

3. The carburation device of claim 2, wherein:

there are two of said blades; and one of said blades is fixedly mounted to serve as a stationary shoulder and the other of said blades is hinged for movement towards and away from said stationary shoulder.

4. The carburation device of claim 2, wherein:

there are two of said blades; and one of said blades is fixedly mounted to serve as a stationary shoulder; and said varying means further includes guides mounting the other of said blades for sliding, guillotine-fashion, towards and away from said stationary shoulder.

5. The carburation device of claim 2, wherein:

said delivering means comprise a calibrated nozzle including a calibrated pin which is longitudinally slidable in a calibrated bore for varying fuel fed by said delivering means between a minimal amount and a maximal amount; and means synchronized with said varying means, for sliding said calibrated pin in said calibrated duct.

6. The carburation device of claim 2, wherein:

said delivering means comprises a fuel injector synchronized with said varying means.

* * * * *